US007030821B2

(12) United States Patent
Mathiae et al.

(10) Patent No.: US 7,030,821 B2
(45) Date of Patent: Apr. 18, 2006

(54) ANTENNA ARRANGEMENT FOR MOTOR VEHICLES

(75) Inventors: Siegfried Mathiae, München (DE); Peter Karl Prassmayer, Grosskarolinenfeld (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/893,529

(22) Filed: Jul. 19, 2004

(65) Prior Publication Data

US 2005/0012670 A1 Jan. 20, 2005

(30) Foreign Application Priority Data

Jul. 17, 2003 (DE) ..... 203 11 035 U

(51) Int. Cl.
*H01Q 1/32* (2006.01)

(52) U.S. Cl. ..... 343/711; 343/725

(58) Field of Classification Search ..... 343/713, 343/711, 725, 727, 893
See application file for complete search history.

(56) References Cited

U.S. PATENT DOCUMENTS 6,348,897 B1 2/2002 Alameh et al. ..... 343/702
6,396,447 B1 * 5/2002 Jonasson ..... 343/713
6,433,749 B1 * 8/2002 Thompson ..... 343/713
2002/0145569 A1 10/2002 Onaka et al. ..... 343/702
2004/0140940 A1 7/2004 Vothknecht et al. ..... 343/725

FOREIGN PATENT DOCUMENTS

| | | |
|---|---|---|
| DE | 201 11 229 U1 | 11/2001 |
| DE | 101 44 403 A1 | 7/2003 |
| WO | 99/04452 | 1/1999 |
| WO | 01/39321 A1 | 5/2001 |
| WO | WO 02/50948 | 6/2002 |
| WO | WO 03/075394 | 9/2003 |
| WO | WO 2004/025778 | 3/2004 |

* cited by examiner

*Primary Examiner*—Hoang V. Nguyen
(74) *Attorney, Agent, or Firm*—Nixon & Vanderhye P.C.

(57) ABSTRACT

An improved antenna arrangement, in particular for motor vehicles having at least two antenna devices, has at least one first antenna element for the mobile radio range and at least one second antenna element. The second antenna element is intended for a different service than the mobile radio range. The lateral distance between the at least one antenna element which is provided for the first antenna arrangement and the antenna element for the second antenna arrangement has at least sections which are $<\lambda/8$, where $\lambda$ represents the wavelength of the mobile radio antenna.

18 Claims, 5 Drawing Sheets

ANTENNA ARRANGEMENT FOR MOTOR VEHICLES

CROSS-REFERENCES TO RELATED APPLICATIONS

This application claims priority from DE Application No. 203 11 035.8, filed 17 Jul. 2003. The entire contents of that application is incorporated herein by reference.

FIELD

The technology herein relates to an antenna arrangement for motor vehicles.

BACKGROUND AND SUMMARY

With regard to the large number of different mobile radio frequencies that are used, it is known for at least two-band antennas to be provided for mobile radio antennas, in particular for the motor vehicle field.

A dual-band antenna for the mobile field has been disclosed, for example, in WO 99/04452. This antenna comprises two antenna elements which are in the form of rods, arranged offset with respect to one another in the axial direction, and connected to one another by means of an intermediate inductance (coil). Those ends pointing towards one another of the antenna elements which are in the form of rods, including the coil arranged between them, are fixed by means of an inductance on the one hand and by means of an externally located conductive sheath, which surrounds everything, on the other hand. This results in an LC tuned circuit between the lower and upper antenna elements. The tuned circuit can be tuned appropriately in order to ensure that, in a low frequency band, the entire antenna element device, with two antenna elements which are arranged offset with respect to one another in the axial direction, is used as an antenna while, in contrast, owing to the blocking effect of the LC tuned circuit in a higher frequency band, only the lower antenna element, with its corresponding length, acts as an antenna in the higher band. Thus, reception and transmission take place only via the one antenna element that is located at the bottom in a higher frequency band range.

However, the antenna nevertheless has a comparatively large physical height, for which reason it appears not to be very suitable, particularly for use as a physically short mobile radio antenna which can be fitted to the outside of motor vehicles. Furthermore, this antenna principle is restricted to a dual-band antenna and cannot be upgraded in the sense of a multiband antenna by means of which, for example, it is possible to receive three or four different band ranges. In general, it is therefore necessary to assess the bandwidth of this antenna as not being sufficient in many cases.

An antenna arrangement has also been disclosed, for example, in DE 201 11 229 U1. This prior publication describes an antenna arrangement for motor vehicles, which has a chassis above which a printed circuit board is arranged, to be precise in order to accommodate circuit components. One or more vertically projecting antenna elements, at least some of which are flat, are provided vertically with respect to the printed circuit board, which is aligned essentially horizontally, to be precise for reception of different services, or in different frequency bands for the mobile radio range.

The overall antenna arrangement is covered by a shroud, which may have a shape similar to fins. Antennas such as these are normally fitted to the motor vehicle bodywork metal sheets, for example at the junction between the motor vehicle roof and the rear windshield.

Furthermore, antenna arrangements are also known in which the printed circuit board that has been mentioned, together with the electronic circuitry components, filter circuits, etc., is first of all provided constructed on a more or less horizontal chassis, and the antenna elements are once again positioned in the vertical direction, at right angles to this. These antenna elements may, for example, comprise not only metallically conductive, self-supporting antenna element devices but, for example, may likewise once again be formed from a printed circuit board element, that is to say in general from a dielectric material, on which metallized surfaces are formed in order to create the antenna elements.

If the aim is now to receive in only one frequency band range, then one antenna element is sufficient. If the aim is to provide two or more services, or if, for example, the aim is to allow communication in different frequency bands in the mobile radio range, then, of course, two or more antenna elements, which are offset with respect to one another, or flat antenna elements are then provided.

The exemplary illustrative non-limiting implementation provides an antenna arrangement, in particular for motor vehicles, which, in addition to at lest one antenna device for the mobile radio range, provides at least one antenna for further services, for example a so-called DAB antenna for reception of digital broadcast radio programs, with the antenna arrangement being intended to have good reception characteristics while occupying a small amount of space overall.

The exemplary illustrative non-limiting antenna arrangement comprises, for example, an antenna with a multiband capability for the mobile radio range from 810 MHz to 960 MHz, as well as from 1710 MHz to 2170 MHz.

If a mobile radio antenna such as this were to be designed with an antenna device for reception of a further service, for example for the DAB-L band (in which case the antenna element required for this purpose would operate in a frequency range from 1452 MHz to 1467 MHz), then, in order to avoid mutual interference between the individual antenna devices for the various services and frequency ranges, attempts would be made to position these antenna devices as far away from one another as possible. This is because the mutual interference would be minimized by maximizing the horizontal distance between the antennas.

Very surprisingly, it has been found that it is possible to minimize the mutual interference between the individual antenna devices, and the lack of omnidirectionality of the polar diagrams resulting from this, not only by maximizing the separation but also by ensuring that the distance between the different antenna devices which have bene mentioned, that is to day the distance between at least one antenna device for the mobile radio range and a further antenna device for a further service, for example for reception of the DAB-L band, has at least sections which are less than lambda/8 $\lambda$ ($\lambda/8$).

In one exemplary illustrative non-limiting implementation, a first antenna device, which is at least provided, and a second antenna device are arranged such that both antenna devices are arranged overall at a distance of less than $\lambda/8$ apart. In this case, "$\lambda$", when it relates to a multiband antenna for the antenna from the mobile radio range, preferably means the wavelength in the uppermost telephone frequency band.

An exemplary illustrative non-limiting implementation provides for the antenna element terminating impedance of the mobile ratio antenna and of the DAB antenna element to be optimized such that the omnidirectionality and gain of the polar diagrams, which are subject to mutual interference caused by the two antenna devices, have optimum values. This can preferably be achieved by means of a suitable filter circuit. In the case of the DAB antenna, this terminating impedance may also be formed by a selective antenna amplifier.

BRIEF DESCRIPTION OF THE DRAWINGS

These and other features and advantages will be better and more completely understood by referring to the following detailed description of exemplary non-limiting illustrative embodiments in conjunction with the drawings of which.

DETAILED DESCRIPTION

Figure 1:
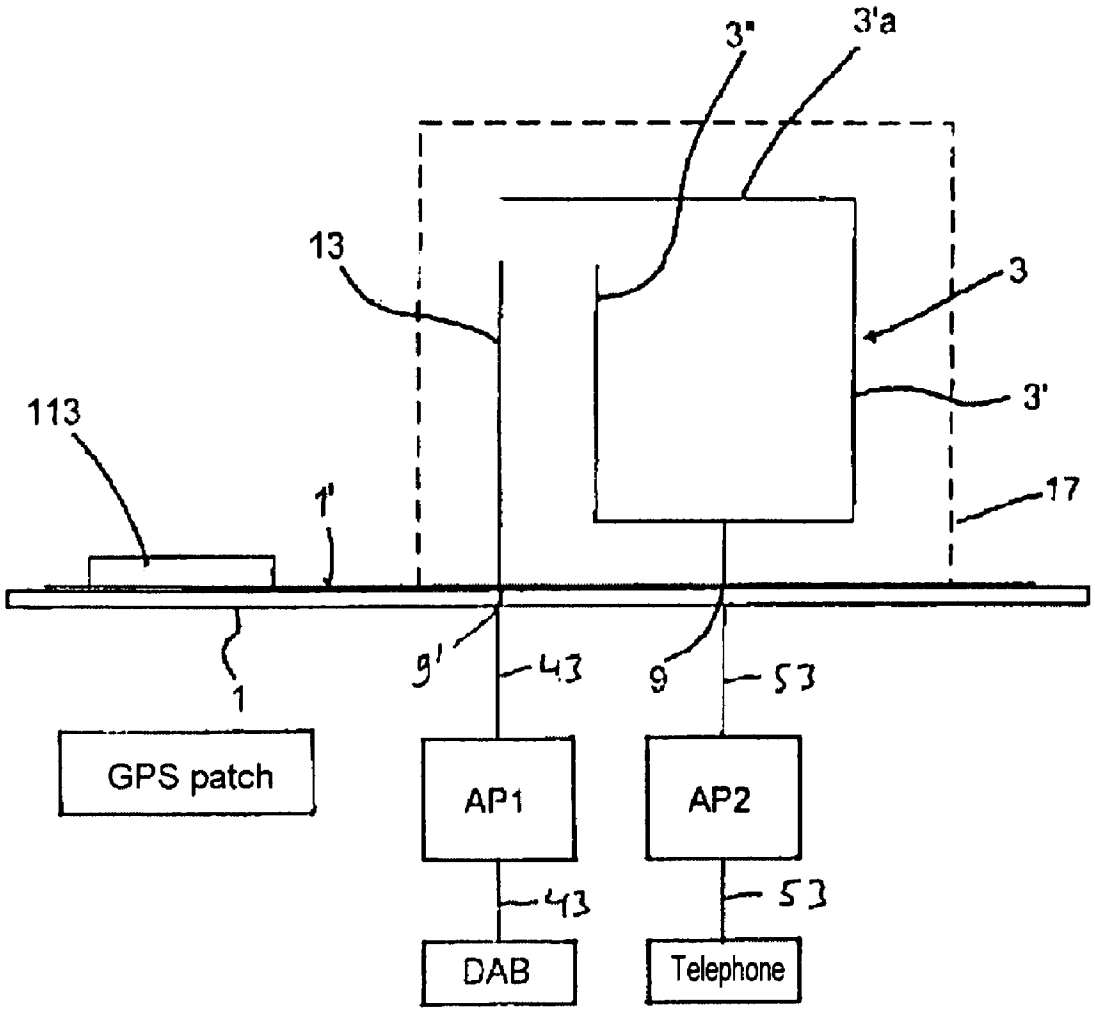
FIG. 1 shows a schematic side view of an illustrative exemplary non-limiting implementation.

FIG. 1 shows, in the form of a schematic side view, an exemplary illustrative non-limiting antenna arrangement having a chassis 1 which, for example, may be in the form of a die-casting, in particular an aluminum die-casting. As is illustrated in the schematic plan view of FIG. 2 this may have a plan view similar to a boat hull or a surfboard, that is to say running from a rather narrower or leading area to a broader, rearward area. However, other arrangements are possible.

Figure 2:
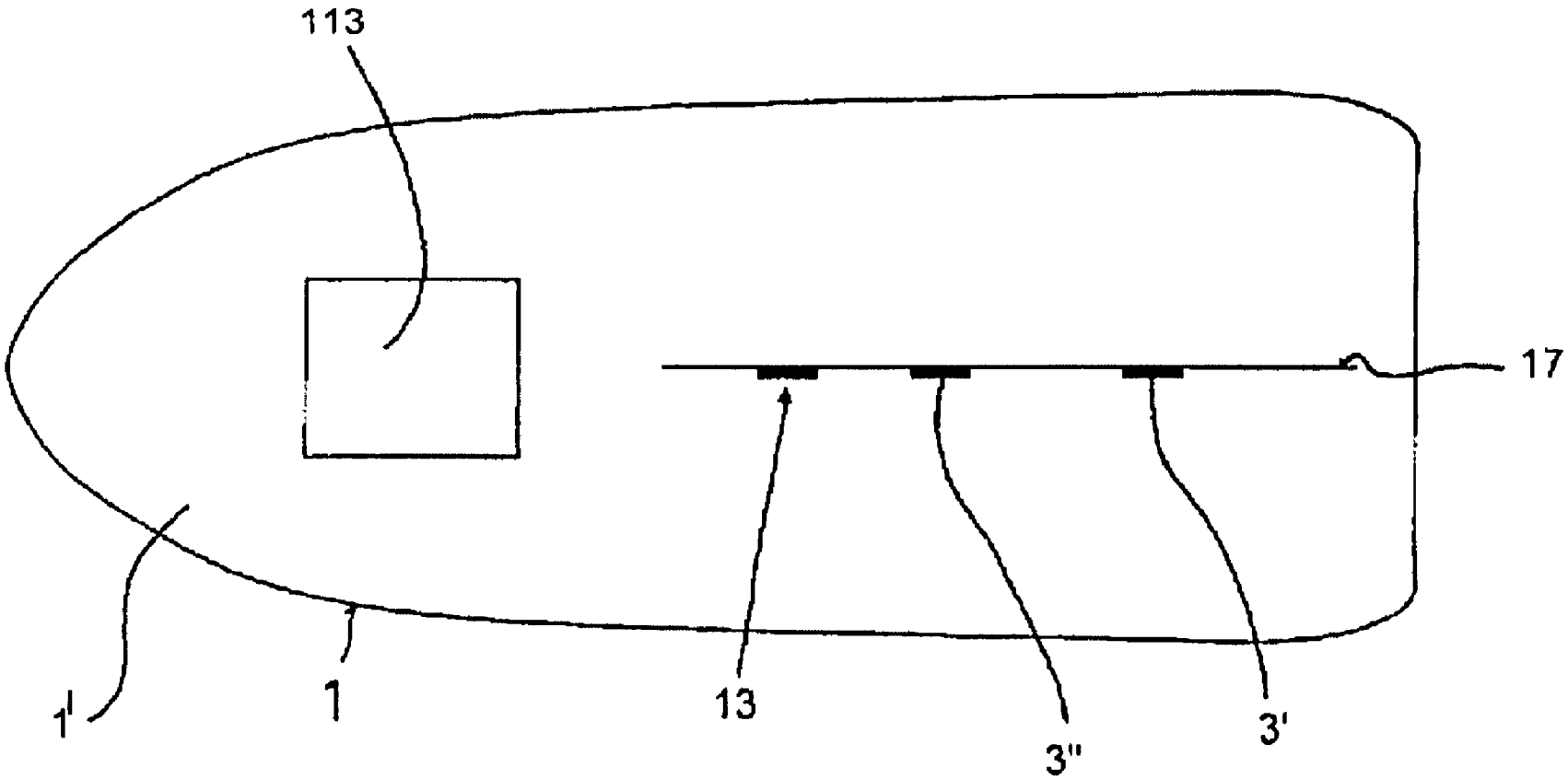
FIG. 2 shows a plan view of the exemplary illustrative non-limiting implementation shown in FIG. 1.

The chassis 1 is illustrated only schematically, both in FIG. 1 and in FIG. 2. It generally comprises a circular rim and a deeper area which is offset inwards from the rim, so that a printed circuit board with generally similar contours (but somewhat smaller external dimensions) can be placed or screwed on the circumferential rim of the chassis 1. The antenna elements which will be explained in the following text are then provided and mounted on the upper face of the printed circuit board. The corresponding electrical and electronic components are then provided on the lower face of the printed circuit board, being soldered on, etc., and are then located in that area in which the chassis is provided with the base that is located deeper than the surrounding rim.

In the illustrated exemplary non-limiting implementation, the antenna arrangement comprises a first antenna device 3 for the mobile radio range with an antenna element 3' for a lower frequency band and an antenna element 3" for the upper frequency band. The antenna element 3' for the lower frequency range is in this case also provided with a line section 3'*a* which is connected, preferably approximately at right angles or horizontally, to a first or effectively vertical antenna element section 3'*b*, and preferably runs at least approximately parallel to the chassis 1. The two antenna elements 3' and 3" have a common feed 9, which is located in the center and is also referred to in some cases in the following text as a foot point 9. The antenna element 3' for the lower frequency range is suitable, for example, for reception from 810 MHz to 960 MHz while, in contrast, the antenna element 3" for the upper frequency band range is suitable from about 1710 MHz to 2170 MHz. Finally, the antennas that have been explained could also be provided with a roof capacitance at their free line section end.

A second antenna arrangement 13, which is suitable for reception of a different service, is now provided, with a lateral offset, in the illustrated exemplary implementation. In the illustrated exemplary non-limiting implementation, this is provided as a DAB antenna device for reception of digital services, that is to say digital radio programs. In particular, it may also be suitable for reception of the so-called L band, that is to say for reception of only regional programs, such as those which are transmitted or are intended to be transmitted in a city area or in population centers. This further or second antenna arrangement is therefore in some cases also referred to as a DAB antenna in the following text.

Thus, in the illustrated exemplary non-limiting implementation, this DAB antenna 13 is provided on the common chassis 1 alongside the first antenna arrangement 1. The antenna is in this case in the form of a monopole antenna and may be physically/spatially in the form of a separate antenna. However, it may just as well be in the form of a conductive surface on a printed circuit board, or on some other substrate. This printed circuit board or the substrate 17 may in this case, for example, accommodate only the DAB antenna 13. A separate printed circuit board or a separate substrate 17 with corresponding conductive surfaces to form the antenna device reproduced there may likewise be provided for the first antenna arrangement. In principle a common printed circuit board or a common substrate 17 is thus suitable, on which not only the first but also the second antenna arrangement are in the form of conductive surfaces.

The printed circuit board which has been mentioned and is illustrated in FIGS. 1 and 2 for accommodation of the antenna arrangement (or in general a substrate) is preferably mechanically anchored on the further printed circuit board 1', which runs parallel to the chassis 1 and/or thus at right angles to or traversely with respect to the printed circuit board 17, and makes contact in an appropriate manner with the electrical and electronic components that are provided there.

Merely for the sake of completeness, it should be mentioned that a third antenna device 113 is also provided in the illustrated exemplary non-limiting implementation, which, in the illustrated exemplary implementation, is formed from a patch antenna element 113. This patch antenna element 113 is in the form of a GPS antenna element, that is to say it is used for positioning and for finding the position of a vehicle that is equipped with the exemplary illustrative non-limiting antenna.

In the illustrated exemplary arrangement, the distance between the DAB antenna 13, that is to say between the antenna element 13 that is provided for the further service and the adjacent first antenna element 3" in the first antenna arrangement for the higher frequency range, is $<\lambda/8$, where $\lambda$ is the wavelength in the upper telephone frequency band.

Finally, as can also be seen from FIG. 1, an appropriate terminating impedance is also provided, with the aid of filter circuits, in order to improve the polar diagram, that is to say in order to achieve a more omnidirectional polar diagram and to achieve a better antenna gain. In this case, as is shown in FIG. 1, the terminating impedance for the DAB antenna element 13 may also be formed by a selective antenna amplifier.

In this case, FIG. 1 shows a connecting line 43, which leads to the DAB antenna 13. A matching circuit AP1 is provided in this connecting line 43 and leads, at its connection end opposite the antenna 13, via the line 43 to the DAB connection or to a DAB amplifier (if fitted). In contrast to the line shown in FIG. 1, the matching circuit AP1 is normally not arranged at an undefined point in the connecting line 43, but is arranged immediately adjacent to the antenna food point 9'. To this extent, the line section 43, illustrated in FIG. 1, between the matching circuit AP1 an the antenna foot point 9' should be regarded as being only schematic and in the form of a block digram. This is because any lines of the antenna foot point are already used for matching transformation, and to this extent should be regarded as part of the matching circuit AP1.

A connecting line 53 in which a further matching circuit AP2 is connected likewise leads to the antenna device 3. At the connection end opposite the antenna device 3, the matching circuit AP2 is connected to a telephone or to a telephone amplifier, if fitted. The above statements also apply in this case. In contrast to the drawing, the matching circuit AP2 is also preferably arranged directly adjacent to the foot point 9 of the antenna 3, so that, in this case as well, the supposed line section 53 between the matching circuit AP2 and the foot point 9 should be regarded only as a schematic block diagram, in order to explain the functional relationship.

The matching circuits AP1 and AP2 which have been mentioned at the foot prints 9' and 9" of the two antenna devices 13 and 3 are in this case preferably provided underneath the printed circuit board arrangement 1', so that they can be connected directly to the foot prints 9' and 9". In this case, the printed circuit boards are provided with appropriate through-plated line connections. As mentioned, the other electrical and electronic components are also preferably arranged on the lower face of the printed circuit board 1', for which reason the shape of the chassis, which is illustrated only schematically in FIGS. 1 and 2, is in practice designed such that, in addition to a circumferential rim or flange area, a central area is provided whose base is lower than the rim or flange area, so that an accommodation area is in this case provided in the chassis 1 for the electrical and electronic components that have been mentioned, including the machining circuits AP1 and AP2. On the basis of this physical arrangement of the circuits AP1 and AP2, it is also evident that the connecting line sections 43 and 53, which are illustrated only schematically in FIG. 1, to a supposed foot point 9' and 9 thus do not exist in practice. To this extent, FIG. 1 is intended only to illustrate the ozone layout.

This matching circuit essentially carries out two functions. Firstly, the antennas are matched to 50 ohms and to the DAB input amplifier (if fitted), respectively, for their respective transmission/reception band.

Secondly, frequency ranges which are within the frequency band of the respective other antennas are transformed such that the impedance at the foot point of the antenna has an advantageous effect on the polar diagrams and on the gain of the antenna. In this case, low impedances (similar to a short circuit) up to medium impedances (for example around 50 ohms) are advantageous. High impedances (similar to an open circuit) are disadvantageous.

This mean that, for example, the impedance of the connected 50 ohm cable which leads to the telephone antenna is transformed by the matching circuit AP2 in the frequency band of the telephone antenna to the complex-conjugate foot point impedance of the telephone antenna (which corresponds to power matching in the transmission band and reception band).

Secondly, the 50 ohms of the cable for the DAB reception band is transformed to a low to medium impedance.

The situation for the matching circuit AP1 is analogous to this, but the other way round. This means that, for example, the impedance of the connected 50 ohm cable which leads to the DAB antenna is transformed by the matching circuit AP1 in the frequency band of the DAB antenna to the complex-conjugate foot-point impedance of the DAB antenna (which corresponds to power matching in the reception band). Secondly, the 50 ohms of the cable for the telephone reception band is transformed to a low to medium impedance.

Figure 3:
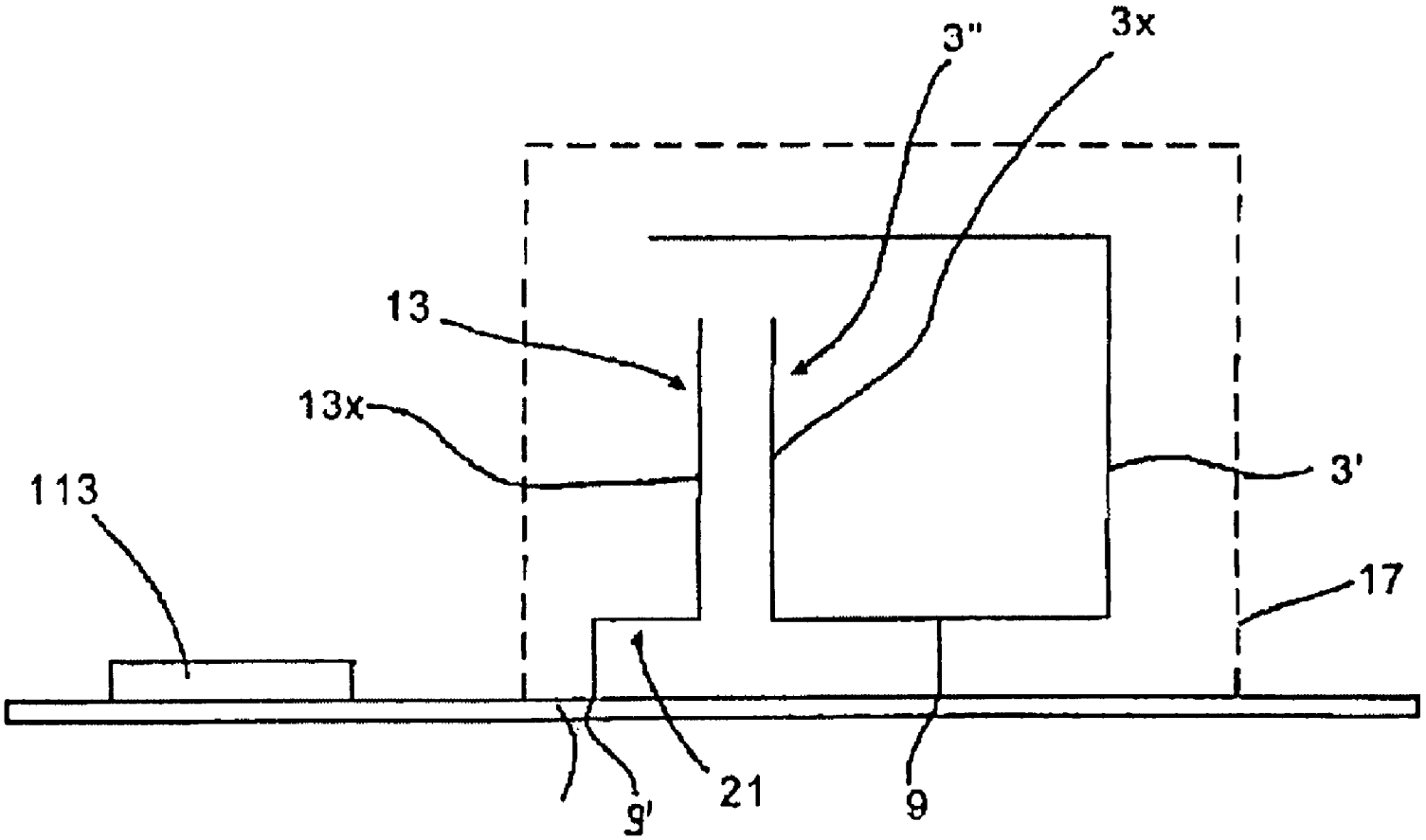
FIG. 3 shows a further exemplary illustrative non-limiting implementation, in the form of a schematic side view, similar to that shown in FIG. 1.

The exemplary non-limiting implementation illustrated in FIG. 3 shows a modified form to the extent that the DAB antenna is formed with a double angle 21 in order to produce a stepped offset. This is used to reduce the overall physical height of the DAB antenna. In this exemplary illustrative non-limiting implementation, and in contrast to FIGS. 1 and 2, the DAB antenna is not arranged such that the DAB antenna is arranged entirely within a distance of $<\lambda/8$ from the adjacent antenna element arrangement 3" for the higher telephone frequency range. In this exemplary implementation as shown in FIG. 3, the arrangement is chosen such that at least sections of the DAB antenna are arranged at a distance of $<\lambda/8$ from the adjacent mobile radio antenna element device 3". This means that, in the illustrated exemplary illustrative non-limiting implementation of FIG. 3, the distance between the feed point or foot point 9 for the first antenna and antenna element arrangement 3 and the foot point or foot point 9' of the second antenna element arrangement 13 may be $>\lambda/8$, with both antenna devices 3, 3" and 13 having at least antenna element sections 3*x* and 13*x* whose section is $<\lambda/8$ ($\lambda$ once again relates to the wavelength in the upper telephone frequency band of the antenna element arrangement 3'). Thus, in the illustrated exemplary non-limiting implementation, the outward antenna sections are arranged opposite the respective food points and foot points 9, 21 with a separation of $<\lambda/8$.

Figure 4:
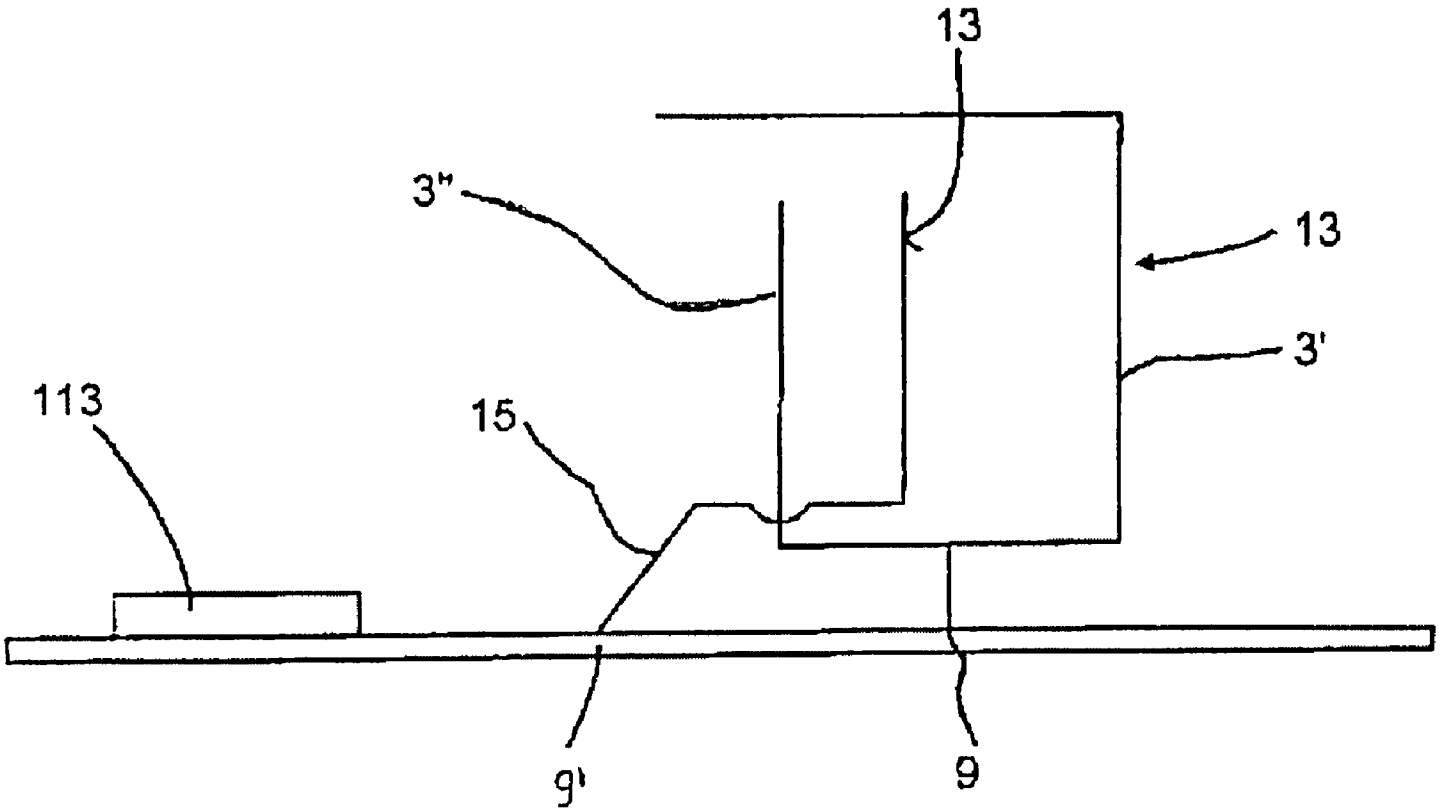
FIG. 4 shows a further modified exemplary illustrative non-limiting implementation, in the form of a schematic side view.

The exemplary illustrative non-limiting implementation in FIG. 4 shows a modified form in which the DAB antenna 13 is arranged between the antenna element device 3' for the lower frequency band and the antenna element device 3" for the upper frequency band. In this case, the antenna element 13 or the corresponding section 13*x* may be arranged approximately in the center between the two antenna elements 3', 3" and the mobile radio antenna device 3, or else offset with respect to the center. In this case, the feed line 15 for the DAB antenna is routed in a corresponding manner and without making any contact past the feed line or the branch line of the antenna device 3 (for example on the opposite side of a printed circuit board when, for example, the first antenna arrangement 1 is formed on one face of the printed circuit board, and the second antenna arrangement 113 is formed on the opposite face of the printed circuit board).

Figure 5:
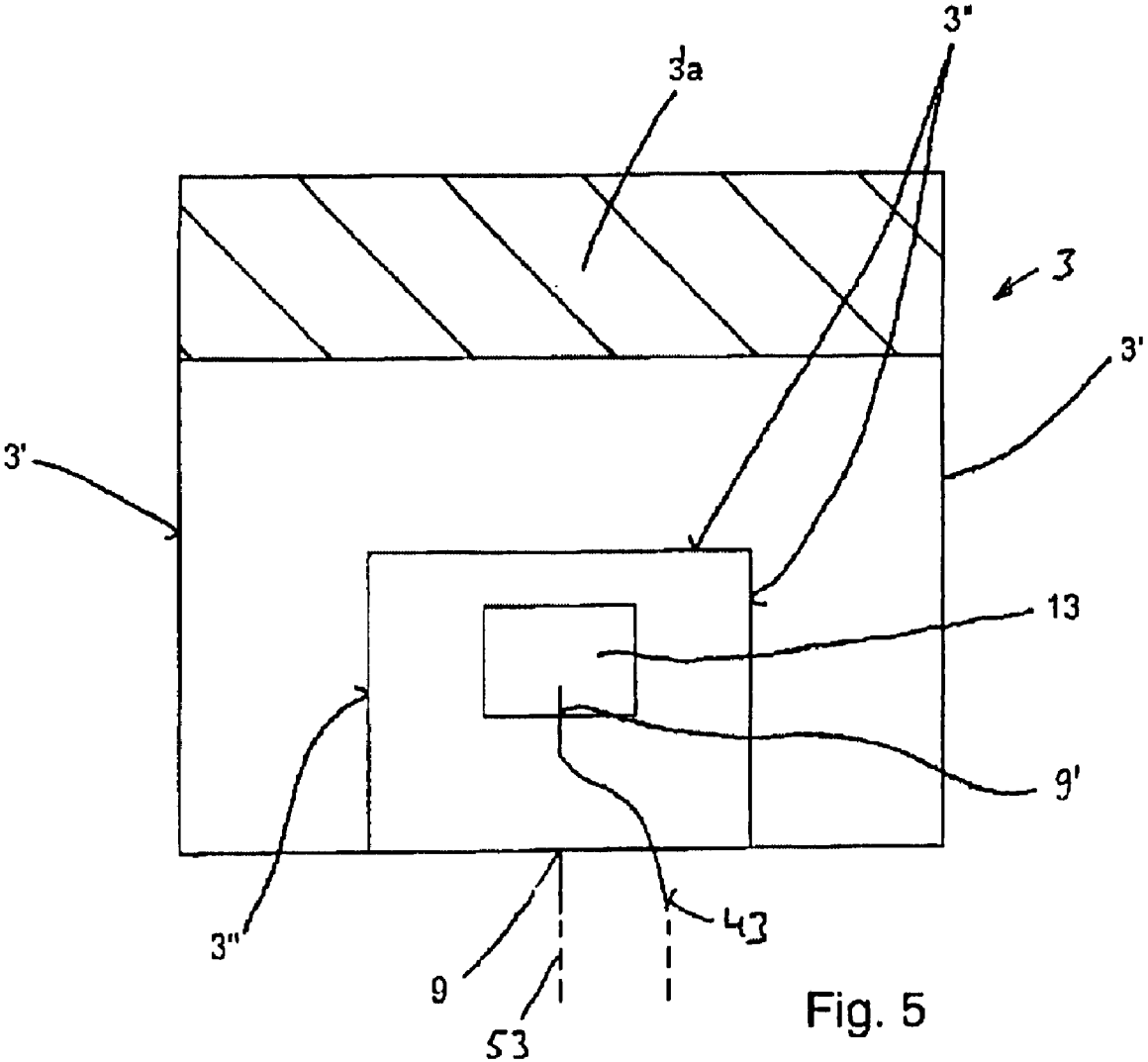
FIG. 5 shows a further modified exemplary illustrative non-limiting implementation, in the form of a schematic side view.

Finally, FIG. 5 shows a further modified exemplary non-limiting implementation, in which the antenna arrangement comprises a mobile radio antenna 3 for a lower and an upper frequency band, and the antenna elements 3' and 3" are in this case designed to be symmetrical, that is to say symmetrical with respect to a vertical center plane. The two antenna elements 3',3" are in this case formed in the manner of an inverted "U". The DAB antenna element 13 is in this case positioned at the center, and is formed with a roof capacitance in order to achieve a shortened form. This makes it possible to produce a particularly omnidirectional polar diagram for all the frequency ranges. As can also be seen from the illustration in FIG. 5 in this case, the antenna section 3'*a* is in the form of a metallized area over the whole surface. The entire antenna arrangement is therefore preferably formed or provided on a substrate, preferably in the form of a printed circuit board.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

The invention claimed is:

1. A vehicular antenna arrangement, for operating at least on a mobile radio frequency range, comprising:

at least one first antenna element for the mobile radio frequency range; and at least one second antenna element for a different service than the mobile radio frequency range, the lateral distance between the at least one first antenna element and the at least one second antenna element having at least sections which are <λ/8 wherein the at least one first antenna element comprises plural antenna elements for reception in different frequency bands offset with respect to one another, and wherein the distance between the at least one second antenna element and an immediately adjacent one of said plural first antenna elements is <λ/8, where λ is the wavelength in an upper frequency band of the plural first antenna elements provided for the mobile radio frequency range.

2. The antenna arrangement as claimed in claim 1, wherein the second antenna element comprises a DAB antenna element.

3. The antenna arrangement as claimed in claim 1, wherein the second antenna element has a terminating impedance comprising a filter circuit.

4. The antenna arrangement as claimed in claim 1, wherein the at least one first and the at least one second antenna element comprise at least antenna element sections whose separation is <λ/8.

5. The antenna arrangement as claimed in claim 1, further comprising a chassis, and a patch antenna in the form of a GPS antenna arranged on the chassis.

6. The antenna arrangement as claimed in claim 5, wherein the first and second antenna elements are arranged on the chassis in the sequence of GPS patch antenna, at least one second antenna element and at least one first antenna element, with said element arrangement with reference at least to feed points said antenna elements.

7. The antenna arrangement as claimed in claim 1, wherein at least one of said antenna elements is provided with a roof capacitance.

8. The antenna arrangement as claimed in claim 1, wherein the second antenna element has a terminating impedance comprising an antenna amplifier.

9. The antenna arrangement as claimed in claim 1, wherein the second antenna element has a terminating impedance comprising a selective operating antenna amplifier.

10. An antenna arrangement for operating at least on a mobile radio frequency range, comprising:

at least one first antenna element operating at a wavelength λ for the mobile radio frequency range; and at least one second antenna element for a different service then the mobile radio frequency range, the lateral distance between the at least one first antenna element and the at least one second antenna element has at least sections which are <λ/8, wherein the at least one second antenna element defines a double angle, such that the feed point of the second antenna element is further away from the at least one first antenna element than an antenna section which is offset with respect to the feed point of the second antenna element, wherein the at least one first antenna element comprises plural antenna elements for reception in different frequency bands offset with respect to one another.

11. The antenna arrangement as claimed in claim 10, wherein the antenna section is located at a distance from the respective feed point at a distance of <λ/8 from a corresponding antenna section of the at least one first antenna element.

12. The antenna arrangement for operating at least on a mobile radio frequency range, comprising:

at least one first antenna element operating at a wavelength λ for the mobile radio frequency range; and at least one second antenna element for a different service than the mobile radio frequency range, the lateral distance between the at least one first antenna element and the at least one second antenna element having at least sections which are <λ/8, and further comprising a further antenna section which runs at an angle to the at least one first antenna element, wherein the at least one first antenna element comprises plural antenna elements for reception in different frequency bands offset with respect to one another.

13. An antenna arrangement for operating at least on a mobile radio frequency range, comprising:

at least one first antenna element operating at a wavelength λ for the mobile radio frequency range; and at least one second antenna element for a different service than the mobile radio frequency range, the lateral distance between the at least one first antenna element and the at least one second antenna element having at least sections which are <λ/8, wherein the at least one first antenna element comprises plural antenna elements and wherein the at least one second antenna element is for DAB reception and is arranged between said plural antenna elements.

14. An antenna arrangement for operating at least on a mobile radio frequency range, comprising:

at least one frequency antenna element operating at a wavelength λ for the mobile radio frequency range; and at least one second antenna element for a different service than the mobile radio frequency range, the lateral distance between the at least one first antenna element and the at least one second antenna element having at least sections which are <λ/8, further comprising a matching circuit coupled to at least one of said first and second antenna elements.

15. The antenna arrangement as claimed in claim 14, wherein the matching circuit transforms the impedance of a connected line in the frequency band of the second antenna element to the complex-conjugate foot-point impedance of the first antenna element.

16. The antenna arrangement as claimed in claim 14, wherein the matching circuit transforms the impedance of a connecting line for the second antenna element to a low to medium impedance, in a range below 80 ohms.

17. The antenna arrangement as claimed in claim 14, wherein the matching circuit transforms the impedance of a connected line in the frequency band of the first antenna element to the complex-conjugate foot-print impedance of the second antenna element.

18. The antenna arrangement as claimed in claim 14, wherein the matching circuit transforms the impedance of a connecting line for the first antenna element to a low to medium impedance, in a range below 80 ohms.

* * * * *